US008387972B1

(12) United States Patent
Ledgerwood et al.

(10) Patent No.: US 8,387,972 B1
(45) Date of Patent: Mar. 5, 2013

(54) PAPER PRESENT SENSING FOR A PAPER TRAY THROUGH MEDIA SIZE SENSING BOARD

(75) Inventors: Adam D. Ledgerwood, Geneva, NY (US); Douglas K. Herrmann, Webster, NY (US); Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/412,059

(22) Filed: Mar. 5, 2012

(51) Int. Cl.
*B65H 1/00* (2006.01)

(52) U.S. Cl. ..... 271/171; 399/393

(58) Field of Classification Search ..... 271/145, 271/171; 399/393; 347/104
See application file for complete search history.

(56) References Cited

U.S. PATENT DOCUMENTS

| | | | | |
|---|---|---|---|---|
| 4,970,544 | A | 11/1990 | Furusawa | |
| 5,897,112 | A | 4/1999 | Kwag | |
| 5,915,690 | A | 6/1999 | Surya | |
| 6,032,004 | A | 2/2000 | Mirabella, Jr. et al. | |
| 6,633,052 | B2 | 10/2003 | Walters et al. | |
| 6,724,506 | B1 | 4/2004 | Wang | |
| 7,854,427 | B2 | 12/2010 | Tsujinishi | |
| 2004/0056413 | A1 * | 3/2004 | Shirakura et al. | 271/145 |
| 2006/0228152 | A1 * | 10/2006 | Kim | 400/624 |
| 2007/0194517 | A1 | 8/2007 | Nose et al. | |
| 2009/0066011 | A1 * | 3/2009 | Ohno et al. | 271/171 |
| 2010/0201063 | A1 * | 8/2010 | Ohno et al. | 271/264 |
| 2011/0127714 | A1 * | 6/2011 | Kuo | 271/171 |

* cited by examiner

*Primary Examiner* — David H Bollinger
(74) *Attorney, Agent, or Firm* — Gibb & Riley, LLC

(57) ABSTRACT

A media sheet tray includes a first media size sensor, a second media size sensor, a first circuit connected to the first media size sensor, a second circuit connected to the second media size sensor, and a switch within the second circuit. The switch can be in an open position disconnecting a continuity of the second circuit, or in a closed position maintaining the continuity of the second circuit. Media being within the media sheet tray closes the switch. Further, a combination of the first circuit connecting to the first media size sensor and the second circuit being discontinuous indicates that paper is absent from the media sheet tray.

20 Claims, 6 Drawing Sheets

PAPER PRESENT SENSING FOR A PAPER TRAY THROUGH MEDIA SIZE SENSING BOARD

BACKGROUND

Embodiments herein generally relate to printing devices and more particularly to sensing the presence of sheets of media in paper trays of printing devices.

In any media feeding system the media must be sensed as being in the tray before feeding can commence. Without a media present sensor, when the feed system tries to feed and is unable because of the lack of media, the next sensor upstream will trip and a paper jam fault will occur. This raises shut down and unscheduled maintenance request rates significantly and upsets customers, because this causes customers to look for paper jams that do not exist.

For systems that do include paper present sensors, these sensors and their dedicated wiring and circuitry add cost, and in a system where pricing is important, any cost reduction is critical. More specifically, conventional paper present sensors include a separate photo-reflective sensor, separate wiring connector, flag, and associated wiring harness and separate pins out that eventually connect to the motherboard of the processor, etc. Such additional components add cost, complexity, and material usage.

SUMMARY

An exemplary printing device herein comprises a processor, a printing engine operatively (directly or indirectly) connected to the processor, and a tray slot comprising a media tray connection. The tray slot is also operatively connected to the processor. A media sheet tray connects to the tray slot. The media sheet tray has an integrated circuit board that, in turn, includes a first media size sensor and a second media size sensor. A first circuit connects the first media size sensor to the media tray connection of the tray slot and a second circuit connects the second media size sensor to the media tray connection of the tray slot.

A switch is positioned within the second circuit, the switch can be in an open position disconnecting a continuity of the second circuit, or a closed position maintaining the continuity of the second circuit. The switch is closed by media being within the media sheet tray. The first media size sensor is operatively connected to the processor when the first circuit is connected to the media tray connection. The second media size sensor is operatively connected to the processor when the switch is in the closed position, and the second circuit is connected to the media tray connection. The combination of the first media size sensor being connected to the processor and the second media size sensor being disconnected from the processor indicates to the processor that paper is absent from the media sheet tray.

The first media size sensor outputs a first measurement of media within the media sheet tray to the processor when the first circuit is connected to the media tray connection, and the second media size sensor similarly outputs a second measurement of media within the media sheet tray, different than the first measurement, to the processor when the second circuit is connected to the media tray connection and the switch is in the closed position.

The media sheet tray can further comprise a media lift plate, and the switch can extend through the media lift plate. The switch can be a pressure switch. Thus, the switch could comprise a conductive rotating member and a conductive contact. The conductive rotating member rotates into a position contacting the conductive contact when pressure from gravitational weight of at least one sheet of media is exerted on the conductive rotating member by the sheet of media is in the media sheet tray. The switch is in the closed position and completes the second circuit when the conductive rotating member is in contact with the conductive contact.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

The devices herein reduce the number of components needed for paper trays by using a size sensing board to determine whether media (paper, transparencies, card stock, etc.) is present in the paper tray. A size sensing board generally has at least two sets of traces (e.g., trace buckets or size sensors) one for lengths and one for widths of paper. The combination of the media location provided by these two traces and the use of a matrix look up table tells the machine the size of the paper used. Therefore, if both traces are contacted by media in the tray, the paper size is determined, if neither trace is contacted the machine can indicate that the tray is not fully inserted into the machine.

With the structures herein, the wiring to one of the trace sets is altered, and the electrical path between the trace and the controller is interrupted by a metal pivoting lift plate that needs to be in a certain position to complete the circuit. Therefore, with the structures herein, if the tray is found to be properly inserted (because one trace is contacted) but the other trace (which connects through the pivoting tray) is not contacted, this indicates to the machine that the tray is empty and allows the machine to display the "out of paper" indication on the user interface. This design reduces cost of paper sensing by substituting a single metal contact switch in place of items such as a dedicated paper-present photo reflective sensor, wiring connector, flag, associated wiring harness, and pins out.

Figure 1:
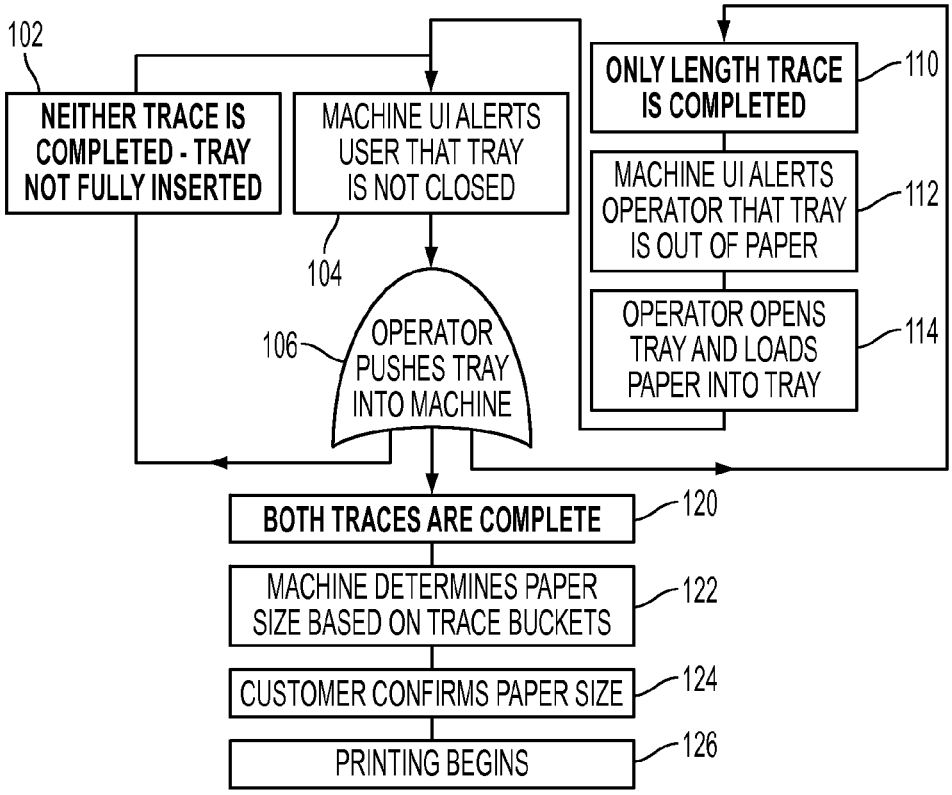
FIG. 1 is a flow diagram illustrating various embodiments herein.

The flow diagram in FIG. 1 shows three potential states that the size sensing board could see when the tray is inserted, and the required actions afterwards to allow printing to commence. Beginning, for example, at item 102, if the paper tray is not fully inserted, none of the traces will be connected and the user interface (UI) of the printer will display a message that the tray is not closed to the user in item 104. In response, the user can fully close the paper tray, as indicated by item 106.

In item 110, if some, but less than all, traces are connected to (or sensed by) the processor, this indicates that the tray is fully inserted, but that the pivoting lift plate has interrupted the connection between one of the traces and the processor. This state indicates that there is no media in the paper tray, and therefore a message indicating that the tray is out of paper is provided on the user interface in item 112. In response, the user will open the paper tray to load paper in item 114 (and, again, items 104 and 106 display a message that the paper tray is not closed).

If both traces are complete (are connected to (or sensed by) the processor) in item 120, the printing machine uses the information from the trace buckets to determine the paper size 122. In item 124, the customer can confirm the paper size to allow printing to begin in item 126. Therefore, as shown in FIG. 1, the three states (both traces complete 120, no traces complete 102, or less than all traces complete 110) provide an indication of whether media is present in the paper tray, as well as the size of the media, all using the same circuitry (with the addition of only a single simple switch connection to complete one of the circuits).

Figure 2:
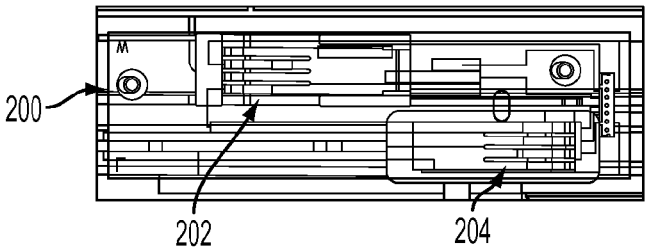
FIG. 2 is a top-view schematic diagram of a device according to embodiments herein.

As shown in FIG. 2, a paper size detection board 200 utilizes at least two sets of traces 202, 204 located on a single circuit board. Contact members (that move when the paper guides of the paper tray move) contact the traces 202, 204, and the position of such contact members on the traces 202, 204 give the detection board 200 width and length measures that the board 200 provides to the processor of the printing device. One set of traces 202 is used to determine the width bucket for a sheet and the other 204 for the length bucket. Using the combination of these two buckets, the paper size currently loaded in an internal tray can be determined and supplied to the printer's processor. This board 200 is also used to verify that the tray is fully pushed into the machine; both traces will not connect to the machine processor, and neither will return a signal, if the tray is not fully inserted into the printing machine.

Figure 3:
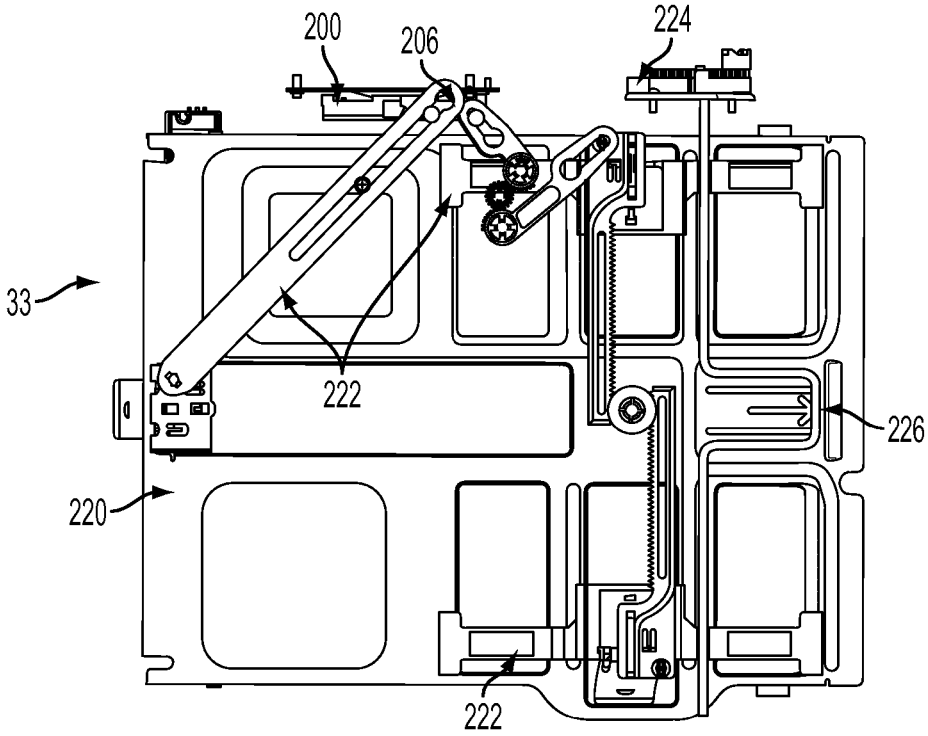
FIG. 3 is a top-view schematic diagram of a device according to embodiments herein.

FIG. 3 is a top view of a paper tray 33 that uses a metal lift plate 220. In FIG. 3, the paper size detection board is again shown as item 200, various paper guides (that include contact members 206 that contact, and move on, the traces 202, 204) are shown as items 222, a lift tray bar is shown as item 226, and an electrical connection element (conductive sponge) is shown as item 224. The ground element 224 provides the electrical power/ground for the traces 202, 204 of the paper size detection board 200.

Figure 4:
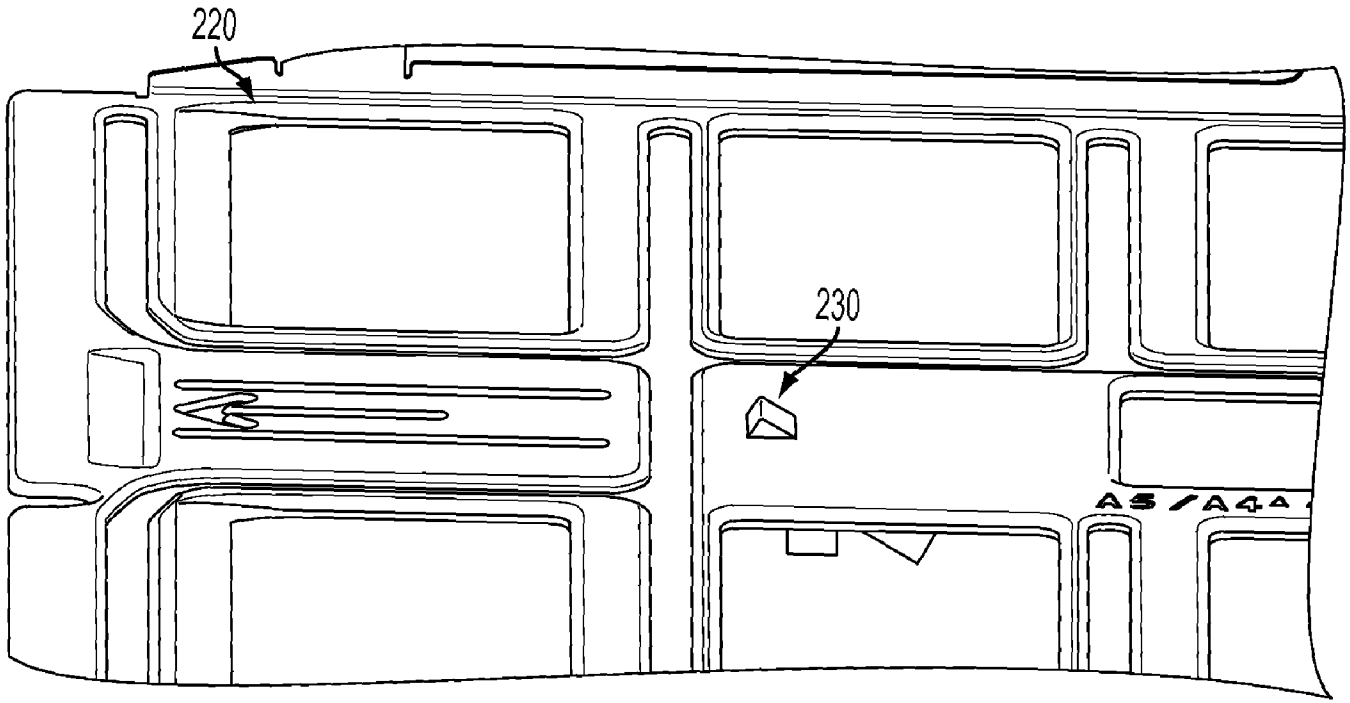
FIG. 4 is a top-view schematic diagram of a device according to embodiments herein.

The metal lift plate 220 is grounded to the printing machine by way of the lifting arm 226 and the electrical connection element 224 on the back of the tray 33. This grounding path is interrupted using a pressure switch 230 that extends through the lift plate 220, as shown in FIG. 4. Therefore, the electrical circuit for the width sensing trace 202 is completed only when the pressure switch is depressed by paper being present in the tray.

As would be understood by those ordinarily skilled in the art, the pressure switch 230 could be located in any desired position and, as shown in FIG. 4, can be located near the front center of the plate 220 to be able to be actuated for all media sizes. Further, the pressure switch 230 can be located away from location of the edges of paper so any amount of paper, even one sheet, will always actuate the pressure switch 230.

Figure 5:
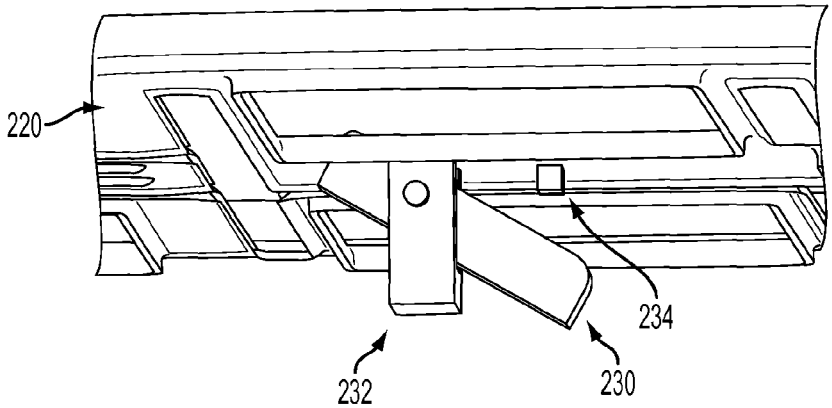
FIG. 5 is a perspective-view schematic diagram of a device according to embodiments herein.

FIG. 5 shows a perspective view of the opposite side of the plate 220 shown in FIG. 4. In FIG. 5, the conductive pressure switch is again shown as item 230, a non-conductive pivot housing is shown as item 232, and a small electrical connection element is shown as item 234. When paper is on the plate 220, the paper will make the pressure switch 230 pivot around and contact the electrical connection element 234, which is attached to the plate 232. The pivot housing 232 is attached to the underside of the plate 220, but is non-conductive. When the pressure switch 230 rotates, it completes the electrical path for the width sensing trace 202 in this example.

Figure 6:
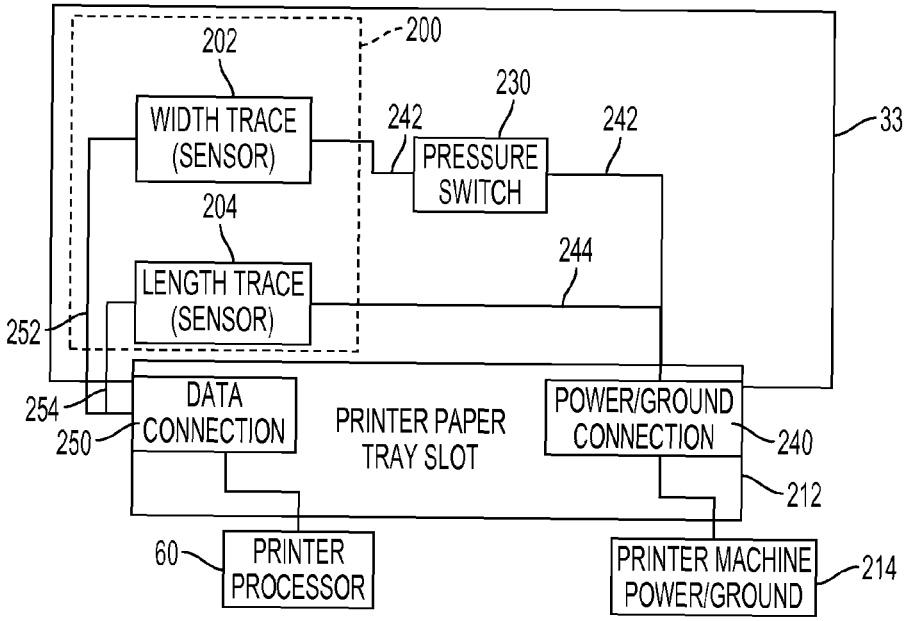
FIG. 6 is a schematic wiring diagram of a device according to embodiments herein.

Exemplary electrical connections are shown in schematic form in FIG. 6. More specifically in FIG. 6, the paper tray is shown as item 33, the paper tray slot of the printing machine is shown as item 212, the paper tray slot power/ground connection is shown as item 240, and the paper tray slot data connection is shown as item 250. The electrical power and/or ground (referred to herein using the "power/ground" shorthand notation) of the printing machine is shown as item 214, and the processor of the printing machine is shown as item 60. Those ordinarily skilled in the art would understand that power could also be supplied through a separate power circuit or through the data connections 250, 252, and that items 214, 240, 242, and 244 could represent only grounding elements in certain embodiments.

Also in FIG. 6, the traces are again shown as items 202 and 204 within the circuit board 200, and the pressure switch is again shown as item 230. The power/ground wiring circuit is shown as items 242 and 244, and the data connection wiring circuit to the traces is shown as items 252, 254.

Note that FIG. 6 illustrates that when the paper tray 33 is fully inserted into the paper tray slot 212 of the printer, the power/ground wiring 242, 244 is electrically connected to the printer machine power/ground 214 through the paper tray slot power/ground connection 240, which connects the traces 202, 204 to the printer machine power/ground 214. Further, when the paper tray 33 is fully inserted into the paper tray slot 212 of the printer, the data wiring circuit 252, 254 is electrically connected to the tray slot data connection 250, which connects the traces 202, 204 to the processor 60 to provide paper size data. If the paper tray 33 is not fully inserted into the paper tray slot 212, the processor 60 will not detect any connection with either trace 202, 204.

As shown in FIG. 6, the pressure switch 230 connects and disconnects one of the traces 202 to and from the power/ground connection 240 by opening or closing circuit 242 depending upon whether paper is present in the paper tray 33. While the width trace 202 is shown as being connected to the pressure switch 230, those ordinarily skilled in the art would understand that in other embodiments, a different trace such as the length trace 204 could be connected to the pressure switch 230 instead.

In this schematic, the width and length traces (sensors) 202, 204 cannot communicate data electrically with the processor 60 unless the traces 202, 204 are electrically connected to power/ground 240, 214. Therefore, when media is on the pressure switch 230, the pressure switch 230 rotates completing the electrical path 242 between the power/ground 240, 214 and the trace 202 and allowing the processor 60 to electrically communicate data with the trace 202 over data line 252. To the contrary, trace 204 has an unbroken power/ground wire 244 and is always connected to the paper tray power/ground connection 240 (which, when the tray 33 is fully inserted into the printing machine paper tray slot 212, is in turn connected to the printer machine power/ground 214). Therefore, trace 204 can always electrically communicate with the processor 60 whenever the tray 33 is fully inserted into the printer paper tray slot 212, regardless of whether paper is in the paper tray 33.

Thus, as shown above, with the structures herein, one trace (for this example the length trace 204, but any trace could be used) is kept with its existing configuration. The other trace (e.g., width trace 202 in this example) however, has its power/ground circuit 242 altered, and the electrical power/ground circuit 242 to complete the circuit is instead run through the pressure switch 230 (that can be, for example, located on the lift plate 220 surface that paper rests on).

If paper is not present, the pressure switch 230 does not actuate, the circuit 242 is not completed, and only one of the two traces (the length trace 204 in this example) is recognized by the processor 60 of the printing machine. When the width trace circuit 242 is opened by the pressure switch 230 not having paper pressure, the width trace 202 is not recognized by the processor 60 of the printing machine, and no bucket information from the width trace 202 is received by the processor 60. When this happens, software logic in the processor 60 then determines that, while the printer tray 33 is fully inserted into the paper tray slot 212 (as is known because the length sensor 204 is in communication with the processor 60), the tray lacks paper because the width sensor 202 is not in communication with the processor 60. Once an operator opens the tray, loads paper, and recloses the tray, both the length and width traces 202, 204 will be in communication with the processor 60. The processor 60 will then know that the tray is fully closed since both traces are complete, that paper is present in the tray, and (using the bucket information from the traces) what size paper is loaded in the machine.

Figure 7:
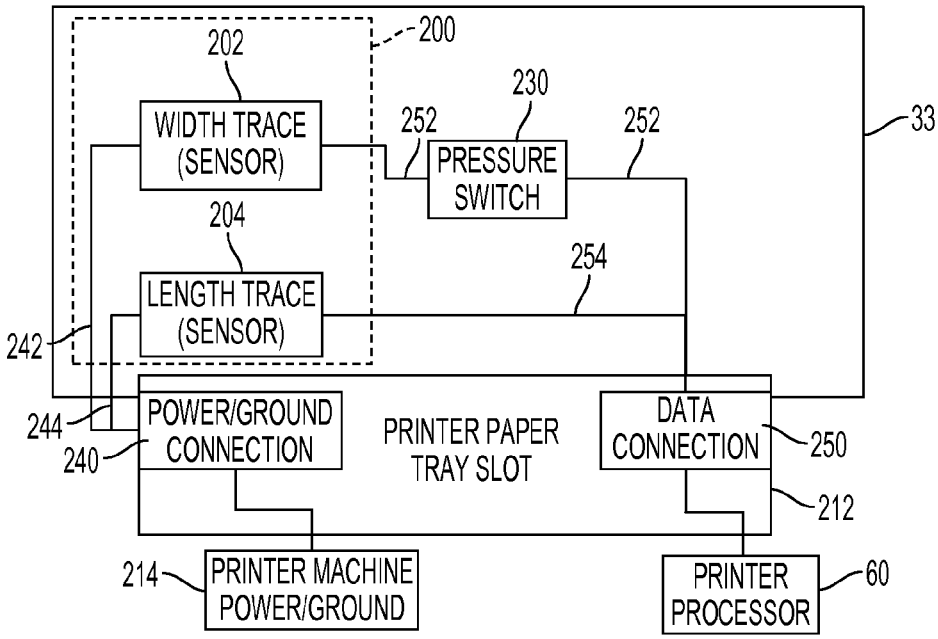
FIG. 7 is a schematic wiring diagram of a device according to embodiments herein.

Alternatively, the switch 230 and electrically connection element 234 could be included within one of the data wiring circuits 252, 254, as shown in FIG. 7. Therefore, in this example, data circuit wiring 252 is connected and disconnected to and from the data connection 250 by the pressure switch 230. Thus, again, the processor 60 receiving communication from only one of the traces (204, in this example) would indicate that the pressure switch 230 has disconnected the other trace 202, which the processor 60 interprets as a paper tray empty situation. Note that FIG. 7 is substantially similar to the structure shown in FIG. 6, except that the positions of the power/ground connection 240 and data connection 250 are switched.

Thus, the structures herein provide a paper present sensor that utilizes another sensor while not diminishing the status resolution that the printing machine has in any area. The structures herein allow for the use of one sensor board to detect three unique and distinct situations: paper present; size of sheet; and tray open/closed. By using the paper lift tray 220 as the power/ground point to complete the circuit 242 when paper is in the tray, this lowers cost (which is useful to many programs and any cost reduction is important) and reduces wiring pin outs and harness size for each feed head.

Figure 8:
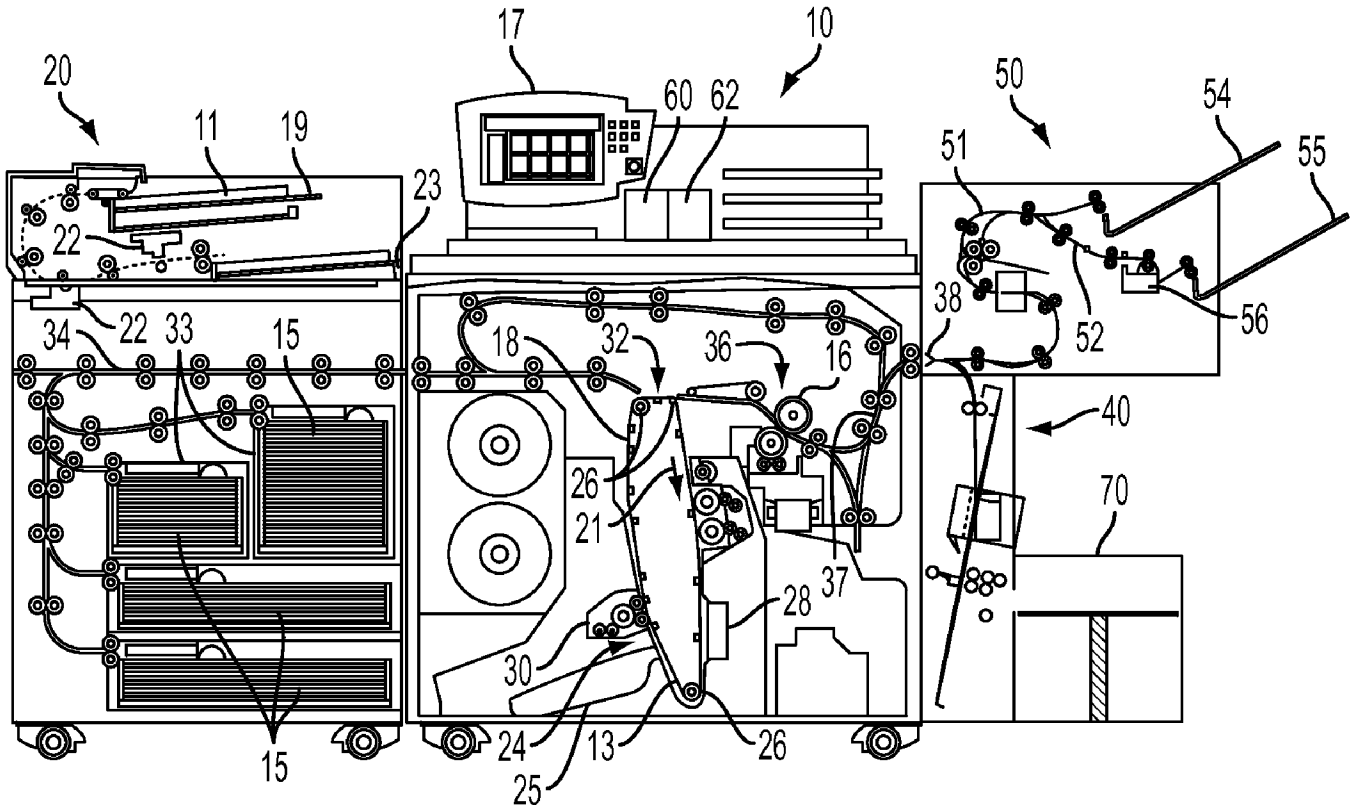
FIG. 8 is a side-view schematic diagram of a device according to embodiments herein.

As shown in to the FIG. 8 a printing machine 10 is shown that includes an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-volatile storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The belt photoreceptor 18 here is mounted on a set of rollers 26. At least one of the rollers is driven to move the photoreceptor in the direction indicated by arrow 21 past the various other known electrostatic processing stations including a charging station 28, imaging station 24 (for a raster scan laser system 25), developing station 30, and transfer station 32.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a sheet output transport 37 to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices, which contact and handle sheets within finisher module 50 are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling As would be understood by those ordinarily skilled in the art, the printing device 10 shown in FIG. 8 is only one example and the embodiments herein are equally applicable to other types of printing devices that may include fewer components or more components. For example, while a limited number of printing engines and paper paths are illustrated in FIG. 8, those ordinarily skilled in the art would understand that many more paper paths and additional printing engines could be included within any printing device used with embodiments herein.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A media sheet tray comprising:

a first media size sensor;

a second media size sensor;

a first circuit connected to said first media size sensor;

a second circuit connected to said second media size sensor; and a switch within said second circuit, said switch being in one of an open position disconnecting a continuity of said second circuit, and a closed position maintaining said continuity of said second circuit, said switch being closed by media being within said media sheet tray, said conductive rotating member rotating into a position contacting said conductive contact when pressure from gravitational weight of at least one sheet of media is exerted on said conductive rotating member by said sheet of media being in said media sheet tray, and a combination of said first circuit connecting to said first media size sensor and said second circuit being discontinuous indicating that paper is absent from said media sheet tray.

2. The media sheet tray according to claim 1, said first media size sensor outputting a first measurement of media within said media sheet tray when said first circuit is connected to a printing device, and said second media size sensor outputting a second measurement of media within said media sheet tray, different than said first measurement, when said second circuit is connected to said printing device.

3. The media sheet tray according to claim 1, said switch comprising a pressure switch.

4. The media sheet tray according to claim 1, said switch comprising a conductive rotating member and a conductive contact, said switch being in said closed position and completing said second circuit when said conductive rotating member is in contact with said conductive contact.

5. A media sheet tray comprising:

a first media size sensor;

a second media size sensor;

a first circuit connected to said first media size sensor;

a second circuit connected to said second media size sensor;

a switch within said second circuit, said switch being in one of an open position disconnecting a continuity of said second circuit, and a closed position maintaining said continuity of said second circuit; and a media lift plate, said switch extending through said media lift plate, said switch being closed by media being within said media sheet tray, and a combination of said first circuit connecting to said first media size sensor and said second circuit being discontinuous indicating that paper is absent from said media sheet tray.

6. A media sheet tray comprising:

an integrated circuit board having both a first media size sensor and a second media size sensor;

a first circuit connecting said first media size sensor to one of power and ground;

a second circuit connecting said second media size sensor to said one of power and ground; and a switch within said second circuit, said switch being in one of an open position disconnecting a continuity of said second circuit, and a closed position maintaining said continuity of said second circuit, said switch being closed by media being within said media sheet tray, and a combination of said first circuit connecting said first media size sensor to said one of power and ground and said second circuit disconnecting said second media size sensor from said one of power and ground indicating that paper is absent from said media sheet tray.

7. The media sheet tray according to claim 6, said first media size sensor outputting a first measurement of media within said media sheet tray when said first circuit is connected to said one of power and ground, and said second media size sensor outputting a second measurement of media within said media sheet tray, different than said first measurement, when said second circuit is connected to said one of power and ground.

8. The media sheet tray according to claim 6, said switch comprising a pressure switch.

9. The media sheet tray according to claim 6, said switch comprising a conductive rotating member and a conductive contact, said conductive rotating member rotating into a position contacting said conductive contact when pressure from gravitational weight of at least one sheet of media is exerted on said conductive rotating member by said sheet of media being in said media sheet tray, and said switch being in said closed position and completing said second circuit when said conductive rotating member is in contact with said conductive contact.

10. The media sheet tray according to claim 6, further comprising a media lift plate, said switch extending through said media lift plate.

11. A printing device comprising:

a processor;

a printing engine operatively connected to said processor;

a tray slot operatively connected to said processor; and a media sheet tray connecting to said tray slot, said media sheet tray comprising:

an integrated circuit board having a first media size sensor and a second media size sensor;

a first circuit connecting said first media size sensor to one of power and ground;

a second circuit connecting said second media size sensor to said one of power and ground; and a switch within said second circuit, said switch being in one of an open position disconnecting a continuity of said second circuit, and a closed position maintaining said continuity of said second circuit, said switch being closed by media being within said media sheet tray, said first media size sensor being operatively connected to said processor when said media sheet tray is connected to said tray slot, said second media size sensor being operatively connected to said processor when said switch is in said closed position, a combination of said first media size sensor being connected to said processor and said second media size sensor being disconnected from said processor indicating to said processor that paper is absent from said media sheet tray, said switch comprising a conductive rotating member and a conductive contact, and said conductive rotating member rotating into a position contacting said conductive contact when pressure from gravitational weight of at least one sheet of media is exerted on said conductive rotating member by said sheet of media being in said media sheet tray.

12. The printing device according to claim 11, said first media size sensor outputting a first measurement of media within said media sheet tray to said processor when said first circuit is connected to said one of power and ground, and said second media size sensor outputting a second measurement of media within said media sheet tray, different than said first measurement, to said processor when said second circuit is connected to said one of power and ground.

13. The printing device according to claim 11, said switch comprising a pressure switch.

14. The printing device according to claim 11, said switch being in said closed position and completing said second circuit when said conductive rotating member is in contact with said conductive contact.

15. A printing device comprising:

a processor;

a printing engine operatively connected to said processor;

a tray slot operatively connected to said processor; and a media sheet tray connecting to said tray slot, said media sheet tray comprising:

an integrated circuit board having a first media size sensor and a second media size sensor;

a first circuit connecting said first media size sensor to one of power and ground;

a second circuit connecting said second media size sensor to said one of power and ground; and a switch within said second circuit, said switch being in one of an open position disconnecting a continuity of said second circuit, and a closed position maintaining said continuity of said second circuit, said switch being closed by media being within said media sheet tray, said first media size sensor being operatively connected to said processor when said media sheet tray is connected to said tray slot, said second media size sensor being operatively connected to said processor when said switch is in said closed position, a combination of said first media size sensor being connected to said processor and said second media size sensor being disconnected from said processor indicating to said processor that paper is absent from said media sheet tray, and said media sheet tray further comprising a media lift plate, said switch extending through said media lift plate.

16. A printing device comprising:

a processor;

a printing engine operatively connected to said processor;

a tray slot comprising a media tray connection, said tray slot being operatively connected to said processor; and a media sheet tray connecting to said tray slot, said media sheet tray comprising:

an integrated circuit board having a first media size sensor and a second media size sensor;

a first circuit connecting said first media size sensor to said media tray connection of said tray slot;

a second circuit connecting said second media size sensor to said media tray connection of said tray slot; and a switch within said second circuit, said switch being in one of an open position disconnecting a continuity of said second circuit, and a closed position maintaining said continuity of said second circuit, said switch being closed by media being within said media sheet tray, said first media size sensor being operatively connected to said processor when said first circuit is connected to said media tray connection, said second media size sensor being operatively connected to said processor when said switch is in said closed position, and said second circuit is connected to said media tray connection, and a combination of said first media size sensor being connected to said processor and said second media size sensor being disconnected from said processor indicating to said processor that paper is absent from said media sheet tray.

17. The printing device according to claim 16, said first media size sensor outputting a first measurement of media within said media sheet tray to said processor when said first circuit is connected to one of power and ground, and said second media size sensor outputting a second measurement of media within said media sheet tray, different than said first measurement, to said processor when said switch is in said closed position, and said second circuit is connected to said media tray connection.

18. The printing device according to claim 16, said switch comprising a pressure switch.

19. The printing device according to claim 16, said switch comprising a conductive rotating member and a conductive contact, said conductive rotating member rotating into a position contacting said conductive contact when pressure from gravitational weight of at least one sheet of media is exerted on said conductive rotating member by said sheet of media being in said media sheet tray, and said switch being in said closed position and completing said second circuit when said conductive rotating member is in contact with said conductive contact.

20. The printing device according to claim 16, said media sheet tray further comprising a media lift plate, said switch extending through said media lift plate.

* * * * *